US006076327A

United States Patent [19]

Hendrickson

[11] Patent Number: 6,076,327

[45] Date of Patent: Jun. 20, 2000

[54] SKIRT GUARD

[76] Inventor: Gary Hendrickson, 10 Meetinghouse Rd., Carlisle, Pa. 17013-1728

[21] Appl. No.: 09/081,820

[22] Filed: May 20, 1998

[51] Int. Cl.[7] ..... E04C 2/38

[52] U.S. Cl. ..... 52/717.05; 52/716.8; 52/102; 52/DIG. 3

[58] Field of Search ..... 52/DIG. 3, 716.8, 52/717.05, 287.1, 102

[56] References Cited

U.S. PATENT DOCUMENTS 3,106,411 10/1963 Holmes .
3,638,374 2/1972 Harby ..... 52/100
3,803,760 4/1974 Matvey ..... 47/33
4,549,378 10/1985 Ayers et al. .
4,843,793 7/1989 Ayers .
5,669,187 9/1997 Bushongon .

*Primary Examiner*—Christopher T. Kent
*Assistant Examiner*—Nkeisha J. Maddox
*Attorney, Agent, or Firm*—Terrance L. Siemens

[57] ABSTRACT

A skirt guard for a mobile home skirt having a skirt track on the ground. The skirt guard comprises an elongated protective panel. A structure is for retaining the elongated protective panel to the skirt track in front of the skirt. The elongated protective panel will cover a lower portion of the skirt and the skirt track, to protect against the damaging effects of a string grass trimmer that trims the grass.

8 Claims, 4 Drawing Sheets

SKIRT GUARD

BACKGROUND OF THE INVENTION

1. Field of the Invention

The present invention relates to mobile home skirts which extend between the bottom of each mobile home and the ground. More particularly, the invention comprises a skirt guard that is used to protect against the damaging effects of gas or electric string type grass trimmers, that trim the grass away from edges where the mobile home skirts meet the ground.

2. Description of the Prior Art

All too often, the whipping force of string trimmers operated by lawn care professionals and mobile home owners that come in contact with the thin vinyl skirts utilized in almost all mobile homes, will produce destructive results. The contact made by the string trimmers will rip and tear the skirts, to form elongated holes. The damage is permanent and creates an unappealing sight between the bottom of the mobile homes and the ground.

Mobile home skirts are shown in U.S. Pat. No. 3,106,411, issued to William V. Holmes on Oct. 8, 1963, U.S. Pat. No. 4,549,378, issued to Ralph L. Ayers, et al. on Oct. 29, 1985, U.S. Pat. No. 4,843,793, issued to Randall w. Ayers on Jul. 4, 1989 and U.S. Pat. No. 5,669,187, issued to Russell Bushong on Sep. 23, 1997.

In each one of these prior art inventions, the skirts above the ground are left unprotected. Since the skirts are made out of a rather thin and brittle material, the slightest force put on them by the spinning strings of string trimmers will rip permanent tears into the skirts.

None of the above inventions and patents, taken either singly or in combination, is seen to describe the instant invention as claimed.

SUMMARY OF THE INVENTION

The present invention is a skirt guard which consists of an elongated protective panel with a flange extending downwardly from a rear surface that engages with a skirt track, so as to protect the skirt and skirt track of a mobile home from damage by a string grass trimmer.

Accordingly, it is a principal object of the invention to provide a skirt guard that will overcome the shortcomings of the prior art devices.

It is another object of the invention to provide a skirt guard that will conveniently slip down over the existing mobile home skirt anchoring ground track, to stand parallel and cover previous scars on the skirt from past contacts made by a string trimmer, as well as offer protection to the mobile home skirt from future trimming encounters.

An additional object of the invention is to provide a skirt guard that is made out of a durable flexible material, to withstand the force of the string trimmer without ripping or scarring in any way and will be able to adjust to slight contours, where the existing skirt matches with the contour of the ground.

A further object of the invention is to provide a skirt guard that is simple and easy to use.

A still further object of the invention is to provide a skirt guard that is economical in cost to manufacture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
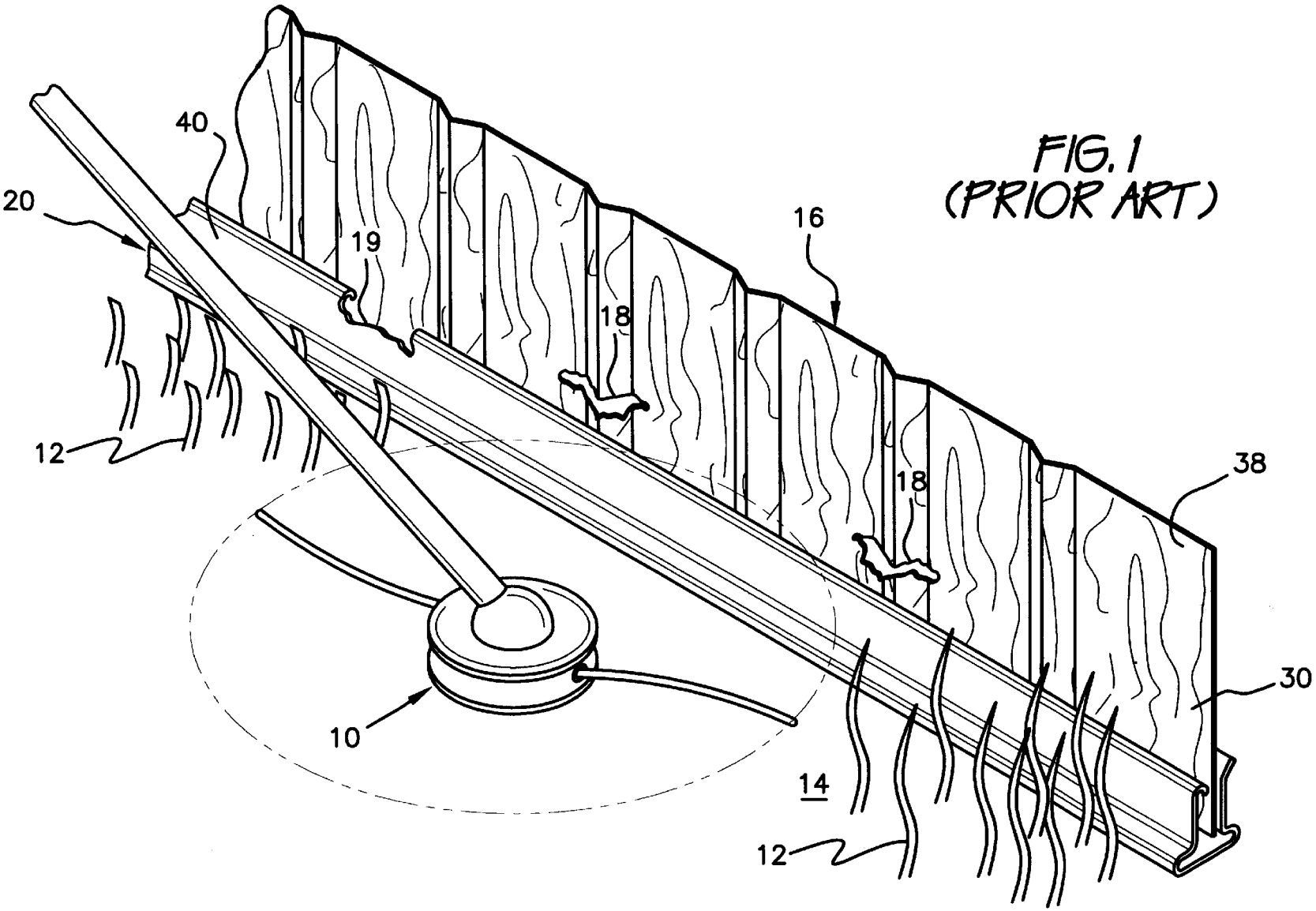
FIG. 1 (PRIOR ART)
FIG. 1 a perspective view of the prior art, showing a string trimmer doing damage to the existing skirt of a mobile home.

Turning now to the drawings, in which similar reference characters denote similar elements throughout the several views, FIG. 1 illustrates the prior art being a string grass trimmer 10, trimming grass 12 on the ground 14. The string grass trimmer 10 rips a skirt 16 of a mobile home and puts elongated holes 18 in the skirt 16. The string grass trimmer 10 can cause damage 19 to a skirt track 20.

Figure 2:
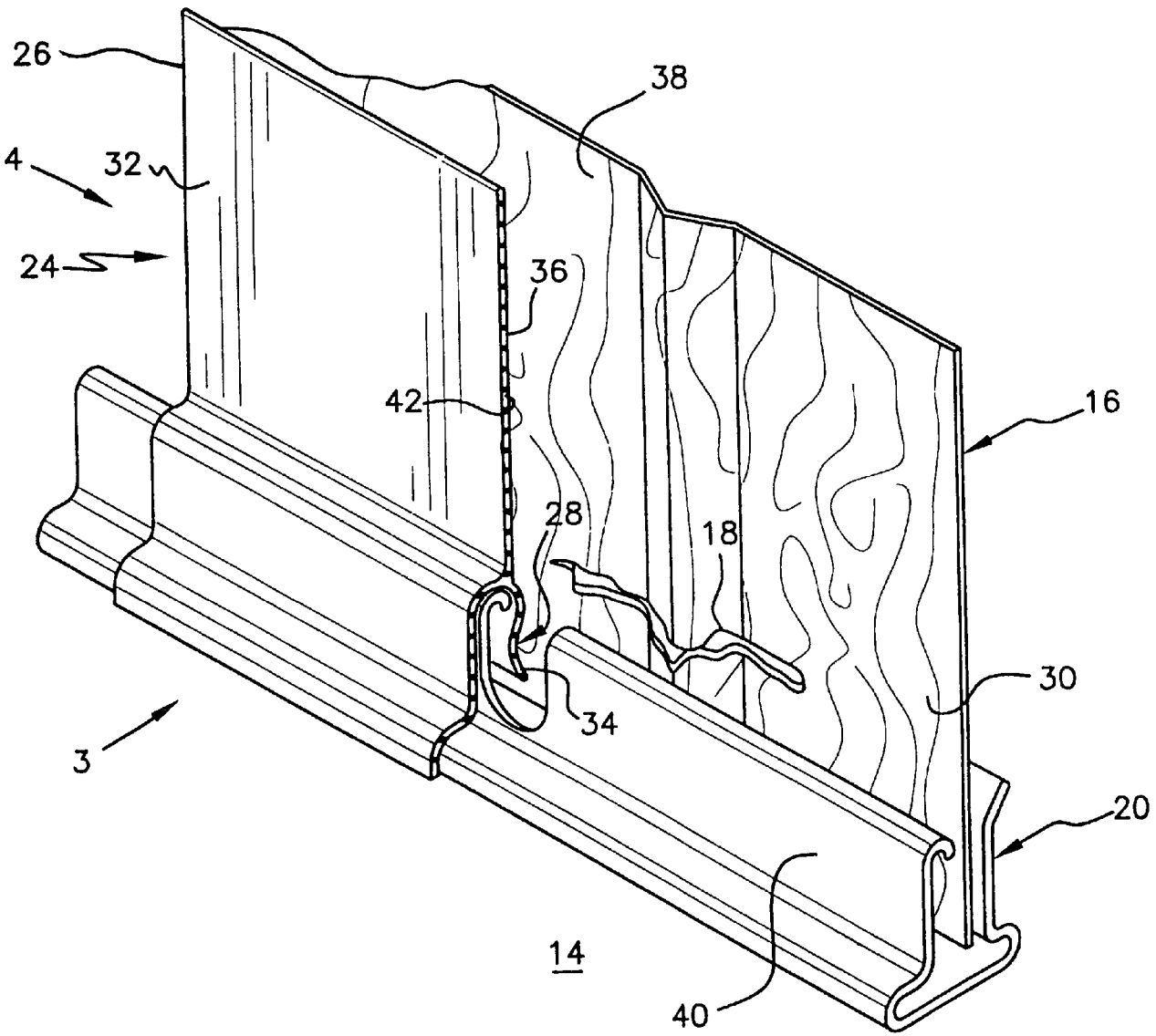
FIG. 2 s a perspective view of a portion of the present invention installed on an existing skirt track covering the existing skirt.
Figure 3:
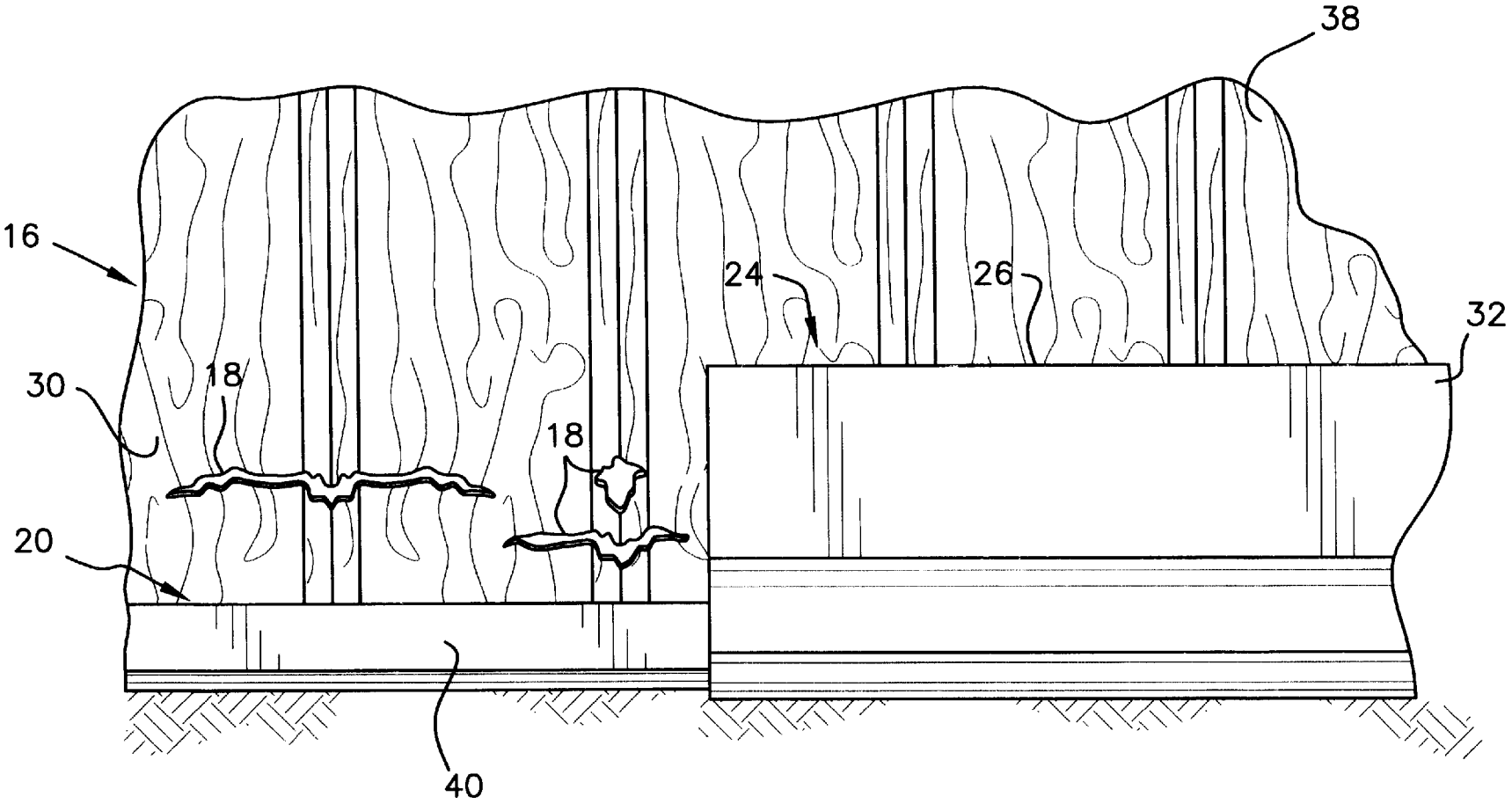
FIG. 3 is a front elevational view taken in the direction of arrow 3 in FIG. 2.
Figure 4:
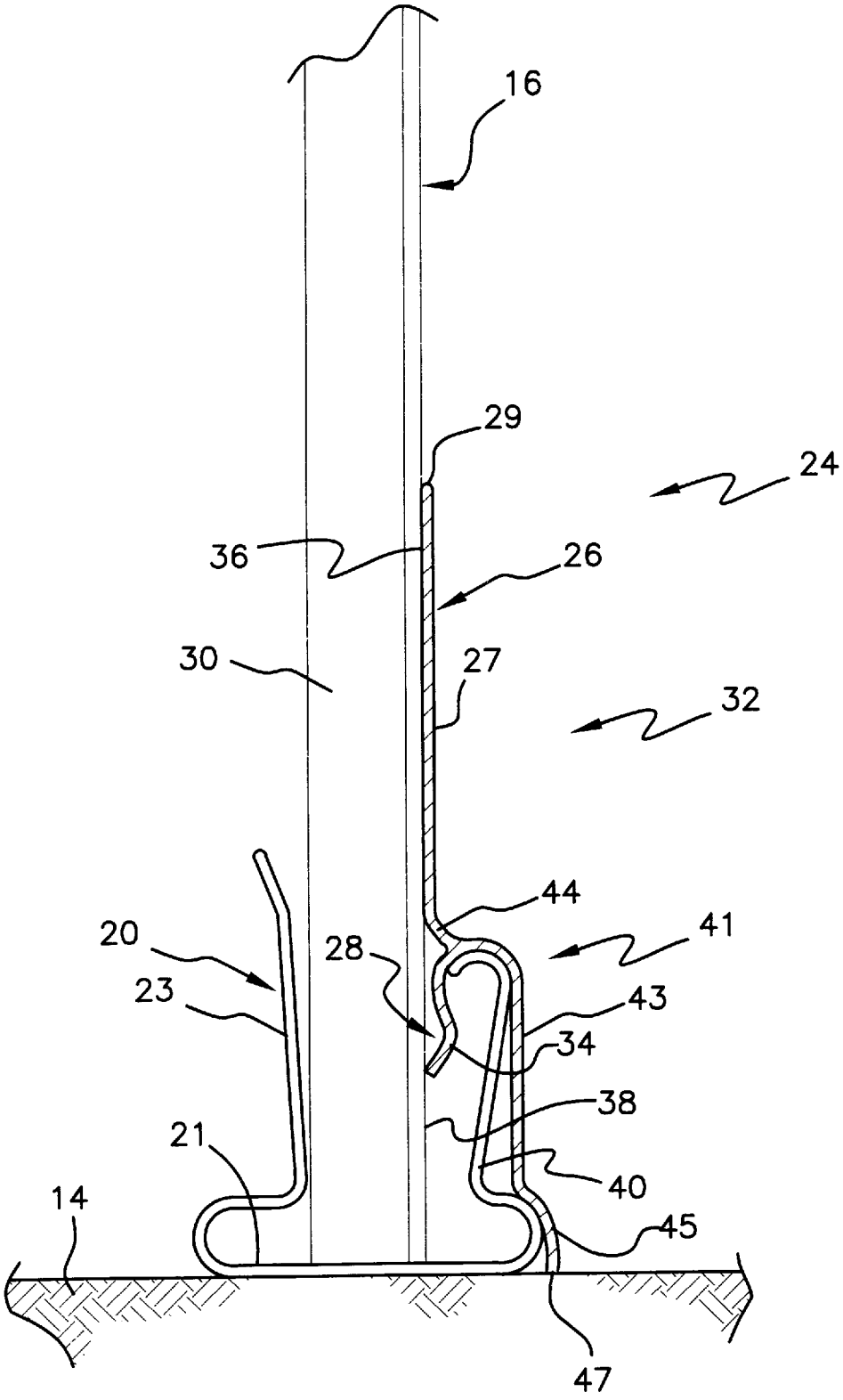
FIG. 4 is a side view taken in the direction of arrow 4 in FIG. 2, with the skirt guard shown in cross section.

FIGS. 2 through 4 show the present invention being a skirt guard 24 for the mobile home skirt 16, having a skirt track 20 on the ground 14. The skirt guard 24 comprises an elongated protective panel 26 and a structure 28 for retaining the elongated protective panel 26 to the skirt track 20 in front of the skirt 16. The elongated protective panel 26 will cover a lower portion 30 of the skirt 16 and the skirt track 20, to protect against the damaging effects of the string grass trimmer 10 that trims the grass 12.

The elongated protective panel 26 is a durable flexible sheet 32 that can withstand the force of the string trimmer 10 without ripping or scarring in any way, and will be able to adjust to slight contours where the skirt 16 and skirt track 20 match up with the contour of the ground 14. The retaining structure 28 includes a flange 34 extending downwardly from a rear surface 36 of the elongated protective panel 26, which fits between a front surface 38 of the skirt 16 and an upstanding forward leg 40 of the skirt track 20 and a forward returning flange 41.

The flange 34 is integral with the elongated protective panel 26, to form a one piece unit. The elongated protective panel 26 with the flange 34 is shaped to properly fit over the upstanding forward leg 40 of the skirt track 20 and against the lower portion 30 of the skirt 16.

It will be seen in FIGS. 1–3 that skirt 16 is a pleated or corrugated vertical panel. Referring now specifically to FIG. 4, skirt track 20 has a floor 21 and an upstanding rear leg 23 attached to floor 21, as well as upstanding forward leg 40 which is also attached to floor 21 and is spaced apart from upstanding rear leg 23. Forward leg 40 and rear leg 23 define a receptacle disposed to receive skirt 16 in close cooperation with skirt track 20.

Elongated protective panel 26 of skirt guard 24 is vertically oriented in the depiction of FIG. 4. Protective panel 26 has a planar front surface 27, planar rear surface 36, a straight top edge 29, and a bottom edge 44. Rear retaining flange 34 of skirt guard 24 depends from protective panel 26 and is attached to protective panel 26 along bottom edge 44.

Forward retaining flange 41 is attached to and projects forwardly from bottom edge 44 of protective panel 26, and projects downwardly below bottom edge 44 in front of rear retaining panel 34. Rear retaining flange 34 and forward retaining flange 41 combine to form a downwardly open channel disposed to receive forward leg 40 of skirt track 20 therein. Skirt guard 24 is thus held in place covering forward leg 40 of skirt track 20 by surrounding engagement of skirt track 20.

Forward retaining flange 41 of skirt guard 24 has a straight vertical section 43 and a forwardly displaced lower section 45 projecting below and in front of straight vertical section 43, for conforming to and covering said skirt. Forwardly displaced lower section 45 of forward retaining flange 41 has a constant thickness and a lowermost edge 47 of width equal to the thickness of forward retaining flange 41. Lower section 45 terminates at lowermost edge 47, thereby contacting the ground 14 along an area no wider than that of lowermost edge 47.

Rear retaining flange 34 is flared to define a funnel for guiding forward leg 40 of skirt track 20 into the channel formed by rear and forward retaining flanges 34, 41 when skirt guard 20 is installed against skirt 16 and over skirt track 20.

The elongated protective panel 26 and the flange 34, can be fabricated out of a strong vinyl material 42, as shown in FIG. 2. The elongated protective panel 26 and the flange 34 can also be fabricated out of a strong lightweight metal material 44, as shown in FIG. 4. If the material to be used for the skirt guard 24 is the vinyl material 42, its strength must be able to withstand the force of the string trimmer 10, without ripping or scarring in any way. The vinyl material 42 will also be fade resistant to sunlight and be offered in three colors: white, tan and brown. Additionally, the vinyl material 42 will be vertically rigid enough to stand parallel to the existing mobile home skirt 16.

The elongated protective panel 26 and the flange 34 are made by an extrusion process. The elongated protective panel 26 with the flange 34 is typically, but not limited to be of a size, four and one half inches high, an eighth of an inch thick and seven feet in length. Depending on the flexibility of the final material chosen for the skirt guard 24, its length could be either seven feet long or of a coiled and boxed length of around twenty feet.

The market for the skirt guard 24 will be the general mobile home owner, who has damage to the skirt 16 and wishes to improve the home's appearance. The skirt guard 24 should also be attractive to the home owner who maintains their own property and has experienced the damaging effects of even the slightest contact of a string trimmer 10 to the skirt 16.

Another market for the skirt guard 24 would be mobile home sales companies who sell and setup new mobile homes. The present invention would be an additional item to offer for sale to a new home buyer and an item that easily could be installed when setting up a new mobile home.

A third potential point of sale might be the management of the mobile home parks themselves. It is these park owners who set the requirements for the parks, and it is in their best interest to maintain the appearance of their parks. Most parks require skirts 16 be installed on trailers, and the skirt guard 24 would cover over existing damage and protect the home owner's investment in required skirting. It is also believed that in a mobile home park, property values are more tightly associated with neighboring homes due to their closeness to one another, and that it would benefit all concerned in having the overall appearance of the mobile homes in a park improved.

It is to be understood that the present invention is not limited to the embodiments described above, but encompasses any and all embodiments within the scope of the following claims.

I claim:

1. A skirt guard and a mobile home skirt having a skirt track on the ground, said skirt guard comprising:

a vertically oriented elongated protective panel having a planar front surface, a planar rear surface, a straight top edge, and a bottom edge;

a rear retaining flange depending downwardly from said protective panel and attached to said protective panel along said bottom edge of said protective panel; and a forward retaining flange attached to and projecting forwardly from said bottom edge of said protective panel and projecting downwardly below said bottom edge of said protective panel in front of said rear retaining panel, wherein said rear retaining flange and said forward retaining flange form a downwardly open channel receiving said skirt track therein.

2. The skirt guard according to claim 1, wherein said rear retaining flange is flared to define a funnel for guiding the skirt track into said channel when said skirt guard is installed against the skirt and over the skirt track.

3. The skirt guard according to claim 1, wherein said forward retaining flange has a straight vertical section and a forwardly displaced lower section projecting below and in front of said straight vertical section, for conforming to and covering the skirt.

4. The skirt guard according to claim 3, wherein said forwardly displaced lower section of said forward retaining flange has a constant thickness and a lowermost edge of width equal to said thickness of said forward retaining flange, and said forwardly displaced lower section of said forward retaining flange terminates at said lowermost edge, thereby contacting the ground along an area no wider than that of said lowermost edge of said forward retaining flange.

5. A skirt for a mobile home, wherein the skirt includes a skirt track for seating said skirt on the ground and a skirt guard, wherein said skirt comprises a corrugated vertical panel, said skirt track has a floor, an upstanding rear leg attached to said floor, and an upstanding forward leg attached to said floor and spaced apart from said upstanding rear leg, thereby defining a receptacle disposed to receive said skirt in close cooperation with said skirt track, and said skirt guard comprises a vertically oriented elongated protective panel having a planar front surface, a planar rear surface, a straight top edge, and a bottom edge, a rear retaining flange depending downwardly from said protective panel and attached to said protective panel along said bottom edge of said protective panel, and a forward retaining flange attached to and projecting forwardly from said bottom edge of said protective panel and projecting downwardly below said bottom edge of said protective panel in front of said rear retaining panel, wherein said rear retaining flange and said forward retaining flange form a downwardly open channel disposed to receive said skirt track therein, whereby said skirt guard is held in place covering said upstanding forward leg of said skirt track by surrounding engagement of said skirt track.

6. The skirt according to claim 5, wherein said rear retaining flange of said skirt guard is flared to define a funnel for guiding said skirt track into said channel when said skirt guard is installed against said skirt and over said skirt track.

7. The skirt according to claim 5, wherein said forward retaining flange of said skirt guard has a straight vertical section and a forwardly displaced lower section projecting below and in front of said straight vertical section of forward retaining flange of said skirt guard, for conforming to and covering said skirt.

8. The skirt according to claim 7, wherein said forwardly displaced lower section of said forward retaining flange of said skirt guard has a constant thickness and a lowermost edge of width equal to said thickness of said forward retaining flange, and said forwardly displaced lower section of said forward retaining flange terminates at said lowermost edge, thereby contacting the ground along an area no wider than that of said lowermost edge of said forward retaining flange.

* * * * *